US005150799A

United States Patent [19]

Long, Jr.

[11] Patent Number: 5,150,799

[45] Date of Patent: Sep. 29, 1992

[54] ANTI-SWAY REEVING SYSTEM

[75] Inventor: Herbert D. Long, Jr., West Allis, Wis.

[73] Assignee: Harnischfeger Corporation, Brookfield, Wis.

[21] Appl. No.: 608,876

[22] Filed: Nov. 5, 1990

[51] Int. Cl.[5] ..... B66C 13/06; B66C 17/00; B66C 19/00

[52] U.S. Cl. ..... 212/147; 212/148; 212/146; 212/213

[58] Field of Search ..... 212/147, 148, 146, 213

[56] References Cited

U.S. PATENT DOCUMENTS 4,953,721 9/1940 Foit ..... 212/147

*Primary Examiner*—Joseph F. Peters, Jr.
*Assistant Examiner*—Kenneth Lee
*Attorney, Agent, or Firm*—Richard C. Ruppin

[57] ABSTRACT

A reeving apparatus for a crane having an overhead frame, a lifting beam subject to swaying forces, and a winding drum mounted on the frame for raising and lowering the lifting beam. First, second, third and fourth spaced apart rotatable sheaves are mounted on the lifting beam for supporting the lifting beam. The first and second sheaves are spaced apart in directions horizontally transverse to a longitudinal axis of the drum. The third and fourth sheaves are positioned generally below opposite ends of the drum. Alternate ones of the sheaves comprise single sheaves having first and second grooves and the other ones of the sheaves each comprise a pair of sheaves each having single grooves. A plurality of ropes are affixed to the drum and to the overhead frame, and each one of the plurality of ropes is wrapped around one of the sheaves for supporting the lifting beam together with the sheaves. The plurality of ropes includes first and second ropes extending to and wrapping around the same alternate one of the sheaves in one of the first and second grooves for generating friction forces with the alternate one of the sheaves in response to swaying movement to thereby dissipate swaying energy. The first and second ropes also each wrap around a single groove of a pair of sheaves of a different other one of the sheaves for supplying rope to the alternate ones of the sheaves to allow limited swaying movement of the alternate ones of the sheaves.

13 Claims, 3 Drawing Sheets

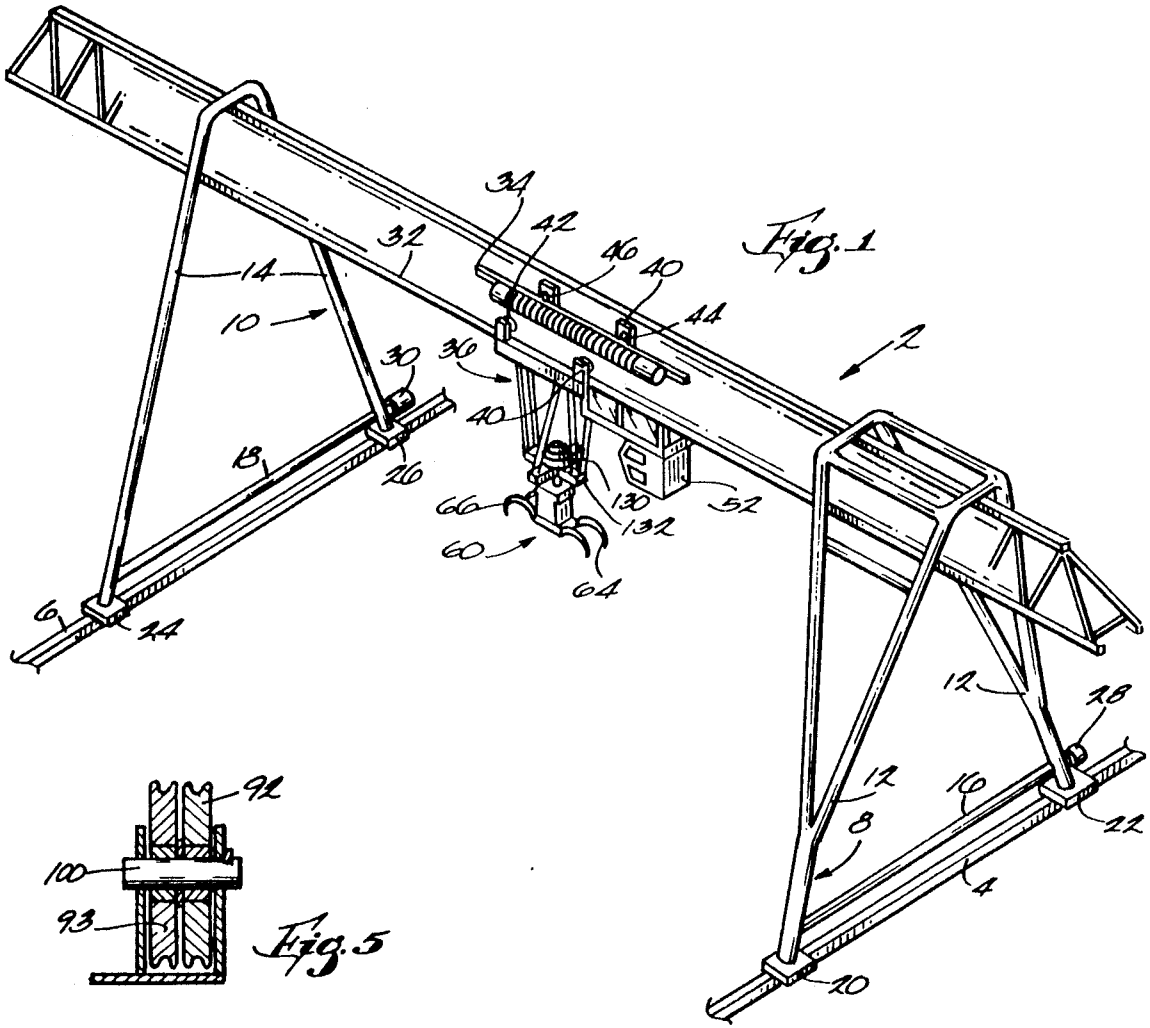
Fig. 1
2
4
6
8
10
12
14
16
18
20
22
24
26
30
32
34
36
38
40
42
44
46
52
60
64
66
130
132
Fig. 5
92
93
100
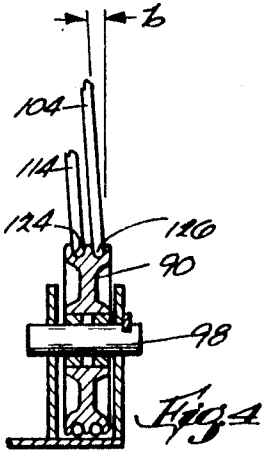
Fig. 4
90
98
104
114
116
124

ANTI-SWAY REEVING SYSTEM

FIELD OF THE INVENTION

This invention relates to an anti-sway crane reeving apparatus and, in particular, to a reeving apparatus in which a load lifting means is suspended from a lifting beam and the reeving apparatus is connected between the lifting beam, an overhead frame carried by the crane, and a winding drum mounted on the frame.

DESCRIPTION OF THE PRIOR ART

In current crane designs, there is an emphasis on high capacity which has been attained by increasing the travel speed of the crane upon its rails and increasing the speed of the load carrying trolley suspended from the frame of the crane. In addition, lifting heights have been raised to thereby increase the amount of material which the crane can span. However, these high speeds and high lifts increase swaying problems of the load lifting means and the load carried by the lifting means which are suspended by a reeving arrangement from the trolley of the crane. During acceleration of the crane on its tracks and acceleration of the trolley on its rails on the frame, and particularly during rapid deceleration of the crane frame or the trolley, the load carrying means and load suspended from the reeving is subject to swaying in directions parallel to the movement of the crane frame and the trolley. A high lift ability and consequent long ropes of the reeving increase the amplitude of the sway. Where the crane is of the gantry type such as a portal crane handling logs, the picking up of the logs from the side of a pile or the carrying of an unbalanced log load can also result in rotational swaying of the load carrying means and log load which is exacerbated by long reeving ropes.

Most reeving arrangements presently in use which are intended to prevent swaying have inadequate stiffness to be effective in current fast and high cranes. The resulting swaying presents a danger of damage to the crane and to the load being carried by the crane. Also, substantial swaying results in a prolonged time cycle of the operation and in excessive rope wear since the ropes tend to jump out of the winding grooves of the crane or rub against sheave flanges or rope guards due to excessive fleet angles.

One reeving arrangement which does provide a high degree of stiffness to prevent swaying is that disclosed in U.S. Pat. No. 4,953,721, and assigned to the assignee of the instant invention. The reeving arrangement disclosed in this patent utilizes double groove single sheaves mounted on the lifting beam of a crane lifting means to resist swaying forces. However, the use of such double groove single sheaves also results in ropes wrapped around the sheaves being ground through and frequently jumping from the sheave grooves. This is a problem particularly at those sheaves around which ropes are wrapped that extend directly from the overhead winding drum. The present invention is an improvement in the reeving arrangement disclosed in U.S. Pat. No. 4,953,721 and is intended to eliminate the problems inherent in it.

SUMMARY OF THE INVENTION

It is a general object of this invention to provide a reeving apparatus for suspending a lifting beam in which the ropes have a reeving path providing a high level of stiffness against swaying of the lifting beam and the load carrying means and load suspended from the lifting beam.

It is a further object of the invention to provide a reeving apparatus for suspending a lifting beam in which there is relatively free rotation movement of ropes around sheaves at high fleet angle sheave and rope engagement locations to thereby minimize jumping of ropes from the sheaves due to the high fleet angles while at the same time providing a high level of swaying stiffness in the reeving apparatus by minimizing rope movement around sheaves at other rope and sheave engagement locations.

Another object of the invention is to provide a reeving apparatus for suspending a lifting beam in which relative high speed rotation of ropes around sheaves is permitted at locations in the reeving system requiring high speed raising and lowering movement of the ropes while at the same time providing a high level of swaying stiffness in the reeving apparatus by minimizing movement of ropes around sheaves at other rope and sheave engagement locations.

The invention is accomplished by providing a crane comprising an overhead frame, a lifting beam subject to swaying forces, and a winding drum means mounted on the frame for raising and lowering the lifting beam, with a reeving apparatus having first, second, third and fourth spaced apart rotatable sheave means on the lifting beam which sway with the lifting beam for supporting and positioning the lifting beam. The first and second sheave means are spaced apart in directions horizontally transverse to a longitudinal axis of the drum means. The third and fourth sheave means are spaced apart in directions parallel to the axis of the drum means and are positioned generally below opposite ends of the drum means.

Alternate ones of the sheave means each comprise single sheaves having first and second grooves and the other ones of the sheave means comprise a pair of sheaves each having single grooves. Each one of a plurality of rope means is affixed to the drum means and to the overhead frame, and each one of the plurality of rope means is wrapped around one of the first, second, third and fourth sheave means for supporting the lifting beam together with the sheave means. The plurality of rope means includes first and second rope means extending to and wrapping around the same alternate one of the first, second, third and fourth sheave means in one of the first and second grooves for generating friction forces with the alternate one of the sheave means in response to swaying movement to thereby dissipate the swaying energy to which the lifting beam is subjected. Each of the first and second rope means also extend to and wrap around a single groove of a pair of sheaves of a different other one of the first, second, third and fourth sheave means for supplying rope to the alternate ones of the first, second, third and fourth sheave means to allow some swaying movement of the alternate ones of the sheave means.

The alternate ones of the sheave means having single sheaves with a pair of first and second grooves may be positioned in opposite horizontally transverse directions from the axis of the drum means, and the other ones of the sheave means may be positioned below the opposite ends of the drum means.

During raising and lowering movement of the lifting beam, the first and second ropes means wrapped around the alternate ones of the sheave means as well as the other ones of the sheave means, are freely rotatable. However, during swaying movement, the first and second rope means and the alternate ones of the sheave means are restrained from movement in response to the friction force generated between them. On the other hand, during swaying movement, the first and second rope means and the other ones of the sheave means continue to be freely rotatable as compared to the rotation movement of the first and second rope means and the alternate ones of the sheave means. The locating of the other ones of the sheave means below the opposite ends of the drum means where the ropes are subject to higher speeds and are subject to higher fleet angles as the ropes travel along the drum means during raising and lowering minimizes jumping of the rope means from the grooves of the other ones of the sheave means.

BRIEF DESCRIPTION OF THE DRAWINGS

Further objects and advantages of the invention will appear when taken in conjunction with the accompanying drawings, in which:

FIG. 1 is a perspective view of a portal crane incorporating the reeving apparatus of the invention;

FIG. 4 is an end-elevational view, partially in cross-section, of a double grooved single sheave utilized in the reeving apparatus of the invention;

FIG. 5 is an end elevation view, partially in cross-section, of a pair of single grooved sheaves utilized in the reeving apparatus of the invention.

DETAILED DESCRIPTION OF THE INVENTION

Figure 2:
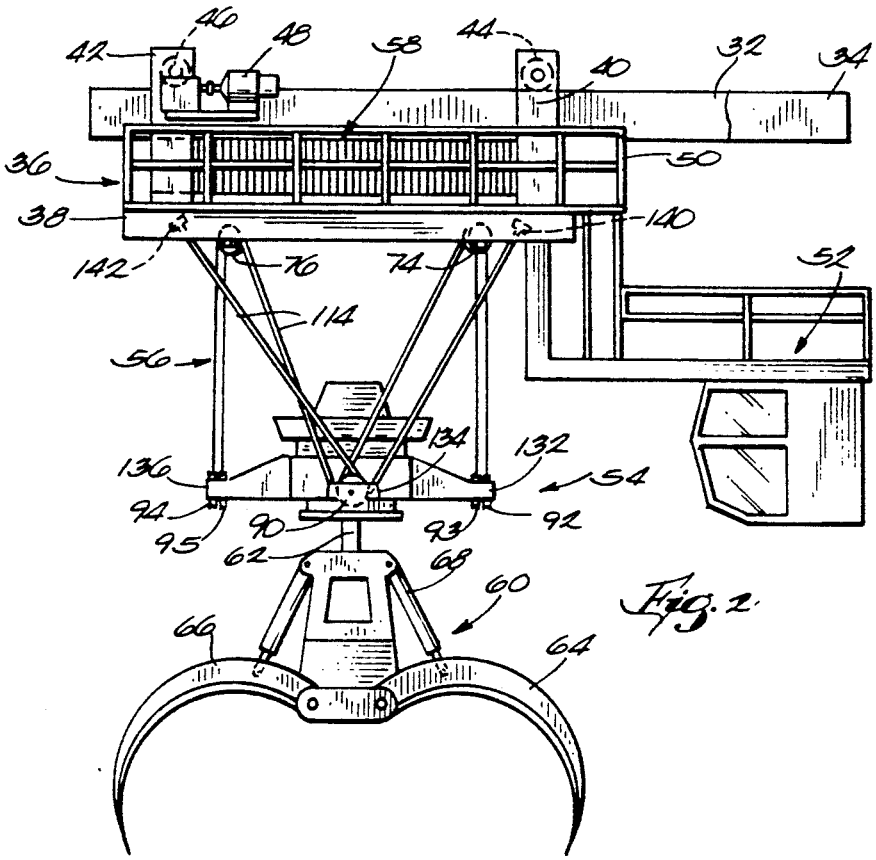
FIG. 2 illustrates a reeving apparatus according to the invention connected between an overhead trolley and a lifting beam from which a load carrying means is suspended.

Referring to FIG. 1 of the drawings, a crane of the portal type incorporating the invention is illustrated as having a frame 2 disposed generally horizontally and overlying two spaced-apart legs 8 and 10 affixed to the frame 2. The rails 4 and 6 run through a storage area for material which is to be lifted and transported into and out of the storage area by the crane. The legs respectively include elongated members 12 and 14, lower bases 16 and 18, and spaced-apart wheel assemblies 20, 22 and 24, 26. The wheel assemblies 20, 22 engage and ride on the rail 4 and the wheel assemblies 24, 26 engage and ride on the rail 6, thus permitting the portal crane to travel along the rails 4 and 6 through the material storage area. Drive motors 28 and 30 are respectively mounted on wheel assemblies 22 and 26 for moving the crane along the rails 4 and 6.

The frame 2 includes a pair of parallel tracks 32 and 34 on which a trolley 36 is carried for travel along the length of the frame 2. The trolley 36 includes an overhead frame 38 from which two pair of legs 40 and 42 extend upwardly and on which a pair of trolley support wheels 44 and 46 are mounted. The wheels 44 and 46 engage the tracks 32 and 34 and support the trolley on the tracks. A trolley drive motor 48 is mounted on one of the pair of legs 46 and drives the wheels 42. A guard rail 50 is affixed to the trolley frame 38 for safety purposes during maintenance of the trolley and an operator cab 52 is also mounted on the trolley.

With reference to FIG. 2, a lifting beam 54 is suspended from the trolley 36 by a reeving apparatus 56 which is affixed to the overhead frame 38 of the trolley, to a winding drum 58 mounted on the trolley frame 38, and to the lifting beam 54. The drum 58 has ends 108 and 118 and a longitudinal axis designated by the numeral 146. A load carrying means such as a grapple 60 may be rotatably connected to the lifting beam 54 by means of a double articulated joint 62 which permits pivoting of the grapple 60 about perpendicular and horizontal axes. The grapple 60 includes a pair of cylinders 68 and 70 which open and close a pair of load carrying arms 64 and 66 for grasping material to be lifted and transported by the crane. The operation of the grapple 60 including the load carrying arms 64 and 66, the winding drum 58, the movement of the trolley 36, and the movement of the crane on the rails 4 and 6 is controlled from the operator 52 to lift, transport and set down material within the travel range of the crane and the trolley.

The reeving apparatus 56, with reference to FIGS. 2–5, includes upper spaced-apart, single-grooved, rotatable sheaves 72, 74, 76 and 78 which are affixed to the overhead trolley frame 38 by means of their mounting respectively on axles 80, 82, 84 and 86 which are attached to the frame 38. The groove in each of the upper sheaves is designated by the numeral 128. Lower first and second sheave means comprising pairs of single grooved single sheaves 92, 93 and 94, 95 are affixed to the lifting beam 54 by means of their being respectively rotationally mounted on axles 100 and 102 which are attached to the lifting beam 54. The sheave pairs 92, 93 and 94, 95 respectively underlie the ends 108 and 118 of the drum 58 and are spaced from each other and from the sheaves 88 and 90 in the directions of the axis 146. Lower third and fourth sheave means comprising double grooved, single rotatable sheaves 88 and 90 are affixed to the lifting beam 54 by means of their being respectively rotationally mounted on axles 96 and 98 which are attached to the lifting beam 54. The sheaves 88 and 90 are spaced apart in opposite transverse horizontal directions relative to the axis 146 of the drum 58. The lifting beam 54 is generally cruciform in shape and has ends 130 and 134 adjacent to which the lower double grooved single sheaves 88 and 90 are respectively affixed and ends 132 and 136 adjacent to which the lower single grooved sheave pairs 92, 93 and 94, 95 are respectively affixed. The grooves in each of the lower sheaves 88 and 90 are identified by the numerals 124 and 126 and the grooves in each of the sheaves 92, 93, 94 and 95 are identified by the numeral 125. A pair of wire ropes 104 and 106 wrap around the winding drum 58 at its end 108 and are affixed to the drum 58 at locations 110 and 112. Another pair of wire ropes 114 and 116 wrap around the other end 118 of the drum 58 and are affixed to the drum 58 at locations 120 and 122.

The reeving apparatus further includes a plurality of wire ropes 104, 106, 114 and 116, each of which follow a separate path respectively including the path of their end sections 105, 107, 115 and 117 which wrap around and extend downward from the drum 58 to a lower sheave 92, 93, 94 or 95. As the rope 104 approaches the lower sheave 92 of the sheave pair 92, 93 from the drum 58, it wraps around the lower sheave 92 in a groove 125 in a clockwise rotative direction when viewed from the end 132 of the lifting beam 54. The rope 104 then extends from the sheave 92 toward an upper sheave 74. At the upper sheave 74, the rope 104 wraps around the groove 128 and continues downward to a lower double grooved sheave 90 and wraps around sheave 90 in groove 126 in a counter-clockwise direction when viewed from the end 134 of the lifting beam 54. The rope 104 then extends upward from the sheave 90 and an end section 103 of rope 104 opposite to end section 105 is affixed to the overhead frame 38 at anchoring location 140. The rope 106 follows another separate reeving path extending between the drum 58 and the lower sheave 93 and wraps around the lower sheave 93 in a groove 125 in a counter-clockwise direction of the rope 104 around sheave 92. The rope 106 then extends from the lower sheave 93 toward the upper sheave 72 in a direction such that the ropes 104 and 106 diverge from each other relative to the vertical in their upward extending directions respectively from the shaves 92 and 93 and generally in the directions of the travel of the crane on the rails 4 and 6. The rope 106 wraps around the sheave 72 in its groove 128 and then extends downwardly to the lower sheave 88. At the lower sheave 88, the rope 106 wraps around the sheave 88 in the groove 124 in a counter-clockwise direction when viewed from the end 130 of the lifting beam 54 and extends upward from the sheave 88 across the path of the rope 106 extending downward to the sheave 88 when viewed in the axial direction of the sheave 88. An opposite end section 109 of the rope 106 is attached to the frame 38 at anchor location 138.

Figure 3:
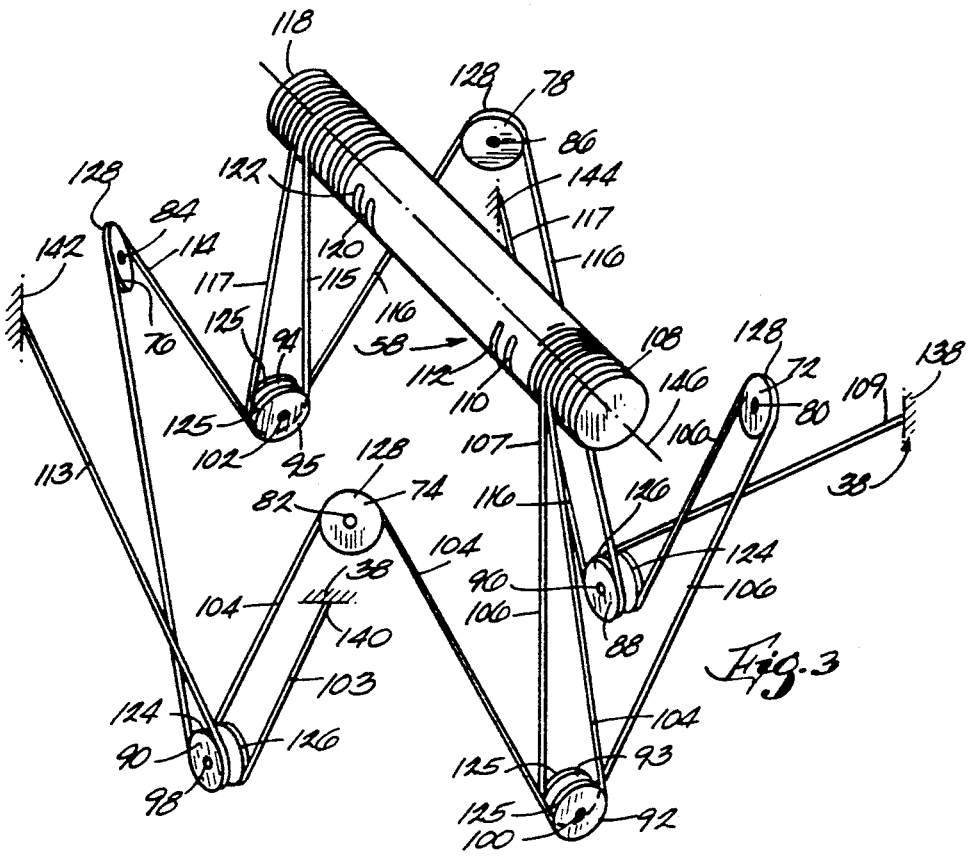
FIG. 3 is a simplified reeving diagram for the reeving apparatus.

The ropes 114 and 116 respectively follow separate paths around sheaves 95, 76, 90 and 94, 78, 88 which are somewhat similar to the paths of ropes 104 and 106 as shown in FIG. 3. At lower double grooved sheave 88, the rope 116 wraps around the sheave in a groove 126 in the same counter-clockwise rotative direction as the wrapping of rope 106 around sheave 88. However, the rope 116 extends upward away from sheave 88 along an end section 117 to anchor location 144 on frame 38 at a different angle from the vertical than the corresponding upward extension of rope 106. The upward extending positions of the ropes 106 and 116 from the sheave 88 are such that they diverge from each other in opposite directions relative to the vertical and transverse to the axle on which sheave 88 is mounted and generally in the directions of travel of the trolley 36 on the tracks 32 and 34. In following this path, rope 116 extends across the path it followed in extending downward to the sheave 88 viewed from the end 130 of the lifting beam 4 in the axial direction of the sheave 88. At lower sheave 90, the rope 114 wraps around the sheave 90 in a groove 124 in the same counter-clockwise rotative direction as the wrapping of rope 104 around sheave 90. However, the rope 114 extends upward at an angle relative to the vertical along an end section 115 to anchor location 142 on frame 38. In following this path, rope 114 extends across the path it followed in extending downward to the sheave 90, viewed from the end 134 of the lifting beam 4 in the axial direction of the sheave 90. The upward extending positions of the ropes 104 and 114 from the sheave 90 are such that they diverge from each other in opposite directions relative to the vertical, transverse to the axle on which sheave 90 is mounted, and generally in the directions of travel of the trolley 36 along tracks 32 and 34. At lower sheave pair 94, 95, the ropes 114 and 116 respectively extend downward from the drum 58 along sections 115 and 117 and wrap around sheave 95 in a groove 125 and sheave 94 in a groove 125 in opposite directions when viewed from the end 136 of the lifting beam in the axial direction of the sheaves 94, 95. The rope 114 then extends upward at an angle relative to the vertical toward upper sheave 76 and around sheave 76 down to double grooved sheave 90. The rope 116 extends upward in an opposite direction to rope 114 at an angle from the vertical to sheave 78 and around sheave 78 down to double grooved sheave 88. The ropes 114 and 116 thus extend upward from sheave pair 94, 95 in diverging directions and generally in the direction of travel of the crane on the rails 4 and 6.

Each of the ropes 104, 106, 114 and 116 have a length along the path the rope follows between the affixation location on the drum 58 and an anchoring location. As the drum 58 rotates to take up or pay out rope, the lifting beam is raised or lowered and the ropes 104, 106, 114 and 116 each travel in the direction of their length between and around the sheaves which they wrap.

Acceleration or deceleration, particularly at a rapid rate, by the crane as it travels on the rails 4 and 6 or by the trolley 36 as it travels on the tracks 32 and 34 will result in swaying forces on the lifting beam 54 tending to cause swaying of the lifting beam, load carrying means 60 and any load that it may be carrying in the directions of the crane travel and/or in the directions of the trolley travel. Also, picking up of unbalanced loads or loads requiring the load carrying means 60 to be positioned at an angle, may result in forces tending to cause swaying in travel trolley directions, crane travel directions, or rotational swaying about a vertical axis. In the case of attempted swaying in the directions of the trolley travel on tracks 32 and 34, a large portion of the swaying will be prevented by friction forces between double grooved single sheaves 88 and 90 and ropes 106, 116 and 104, 114 due to the friction between the ropes and the grooves 124, 126 in each sheave 88 and 90, and due to the tension on the ropes from the loads of the lifting beam, the load carrying means and any load carried by the latter, and swaying forces of the lifting beam, load carrying means and any load. For example, in the view of FIG. 3, sway force on the lifting beam 54 in the direction of the drum axis 146 to the right will correspondingly apply force on sheave 90 attempting to rotate it. However, the tension of the rope 114 at the upward diverging angle to the left and the friction of rope 114 along its wrapped around engagement area with groove 124 of sheave 90 provides a friction force along the grooves of the sheave 90 which dissipates the energy of the sway force to the right and thereby inhibits further sway movement to the right or left. If the sway force on the lifting beam 54 is to the left in the direction of axis 146, the tension of rope 104 at the upward diverging angle to the right and the friction of rope 104 with groove 126 of sheave 90 provides a friction force along the grooves of the sheave 90 which dissipates the energy of the sway force and thereby inhibits further sway movement to the left or right. Since the ropes 104 and 114 wrap around the same single sheave 90 and extend in opposite directions away from the sheave, the combined friction force generated by the two ropes with a single sheave quickly stops swaying movement. Thus, the sway energy is dissipated by friction between the ropes and sheaves along the grooves of the sheave rather than by continued significant sway movement until the sway energy is dissipated in the entire hoist system. The ropes 106, 116 and the sheave 88 function in the same manner as ropes 104, 114 and sheave 90 to prevent sway in the directions of the trolley travel.

Where the attempted sway movement is in the directions of the crane travel on rails 4 and 6, the sway movement will be resisted by the ropes 104, 106 and 114, 116 due to their being respectively wrapped around each of the sheaves of the sheave pairs 92, 93 and 94, 95 and their diverging away from each other in the directions of the travel of the crane on the rails 4 and 6 up to the upper sheaves 72, 74 and 76, 78. The energy of the sway movement is dissipated by the resisting force in the ropes 104, 106 and 114, 116 on the sheave pairs 92, 93, and 94, 95 and by the rolling movement of the sheaves 92, 93 and 94, 95 on the ropes which is somewhat toward the sheaves 88 or 90 and slightly upward along circular arcs of which the rope sections 105, 107 and 115, 117 are approximate radii. Further, sway movement of the sheave pairs 92, 93 and 94, 95 in the direction of travel of the crane on the rails 4 and 6 results in attempted movement of the ropes 104, 106 and 114, 116 upward from the double grooved single sheaves 88 and 90 since the ropes run continuously from the sheaves 92, 93 and 94, 95 to the sheaves 88 and 90. This rope movement results in the more highly sway resistant sheaves 88 and 90, and the ropes wrapping around them, resisting sway movement in the crane travel direction in a manner similar to the resistance by the sheaves 88 and 90 of sway movement in the trolley travel direction. In functioning in this manner, the sheaves 88 and 90 are less movable in response to sway forces than the sheaves 92, 93 and 94, 95 so that the sheave 88 and 90 decrease or restrain the travel of the ropes toward the sheaves 92, 93 and 94, 95 to thereby also decrease the sway movement of the sheaves 92, 93 and 94, 95. Also, the greater movement of the sheaves 92, 93 and 94, 95 in response to sway forces results in the travel movement of the ropes from the sheaves 92, 93 and 94, 95 toward the sheaves 88 and 90 to supply rope permitting increased sway movement of the sheaves 88 and 90. Thus, an anti-sway effect from the combined different types of sheaves 92–95 and 88, 90 is provided which is greater than possible with sheaves only of the types of sheaves 92–95 and is somewhat less than possible with sheaves only of the type of sheaves 88, 90. The result is that both a relatively low level of sway occurs and jumping of the ropes from the sheave grooves and high rope wear is minimized.

Figure 6:
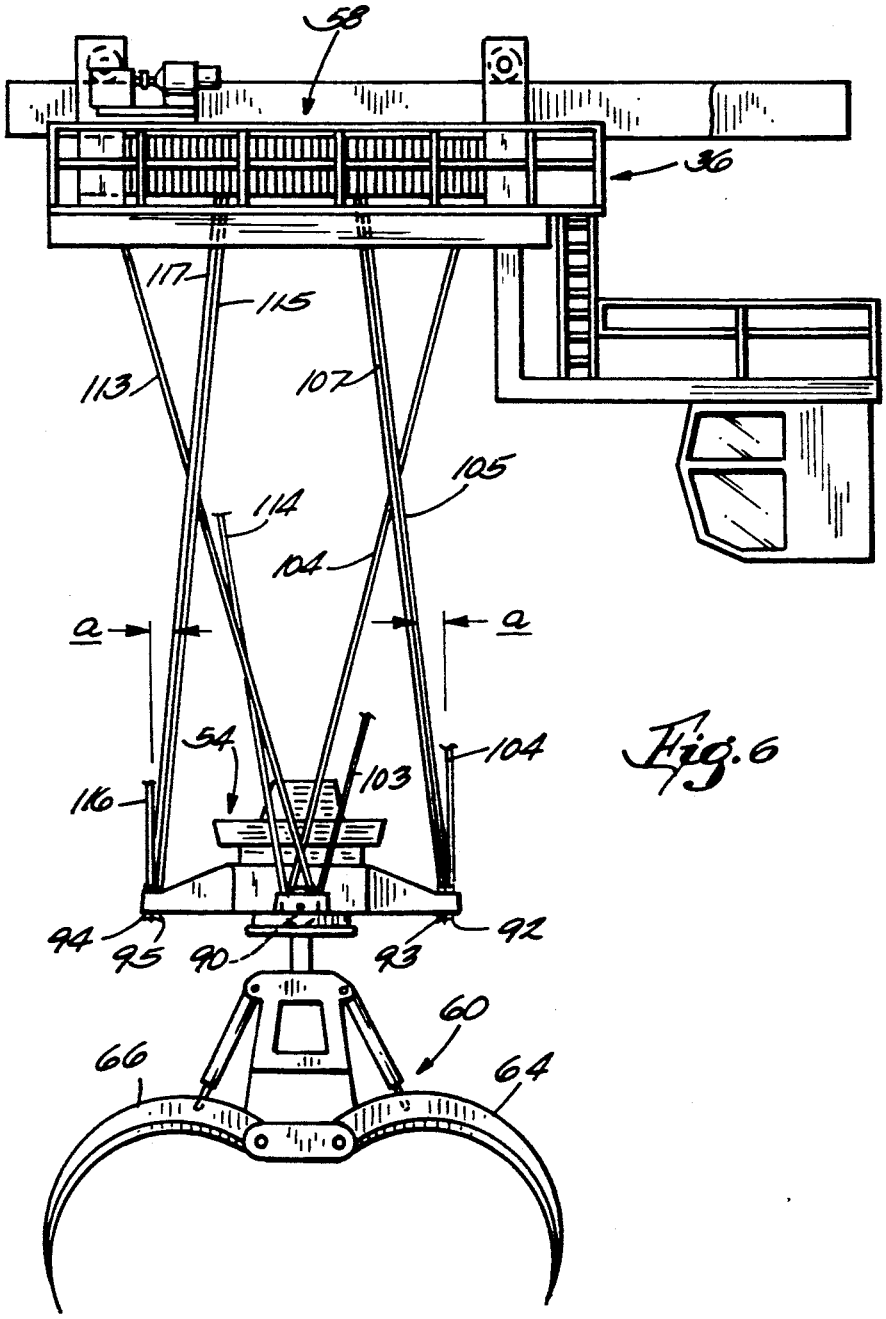
FIG. 6 is a simplified view of a portion of the reeving apparatus illustrating the rope position when a large amount of rope is payed out from the drum.

With reference to FIGS. 4 and 6, the end sections 105, 107 and 115, 117 of the ropes 104, 106 and 114, 116 extend at relatively large fleet angles a with the grooves 125 of the sheave pairs 92, 93 and 94, 95 when a substantial amount of the rope is payed out from the drum 58 during a lifting or lowering operation. This is not the case with respect to the fleet angles b of the ropes 104, 106 and 114, 116 with the grooves 124, 126 of sheaves 88 and 90 since the sheaves 88 and 90 and 72, 74, 76 and 78 are positioned such that the fleet angles of their wrapping ropes is small and the sheaves 88 and 90 do not significantly move in their axial directions during lifting and lowering operations. Large fleet angles tend to cause ropes to jump out of sheave grooves. Further an anti-sway reeving arrangement having double grooved single sheaves, such as sheaves 88 and 90, exacerbates the tendency of the ropes to jump out of the sheave grooves when subjected to larger fleet angles. This is believed to be due to the vibration of the ropes when they slide along the double grooved sheaves. On the other hand, independently rotatable double sheaves, such as sheave pairs 92, 93 and 94, 95 through which ropes extending downward from the drum are directly connected, have a much lower tendency to cause the ropes to jump out of the grooves due to lateral forces on the ropes caused by the fleet angles. This is believed to be due to the rotating of the ropes with the sheaves so that "grip" is maintained between the two.

In the reeving arrangement of the invention, use of single groove double sheave pairs wrapped by the ropes extending directly to the drum which are subject to higher fleet angles and double grooved single sheaves with the wrapping ropes which do not extend directly up to the drum and which are not subject to higher fleet angles provides several important benefits. The combination of the two types of sheaves at the proper locations enables a high level of anti-sway resistance in directions transverse to the longitudinal axis of the drum and permits additional anti-sway resistance in directions parallel to the axis of the drum while at the same time minimizing jumping of ropes from grooves of sheaves to which the ropes directly extend from the drum.

During a raising or lowering operation, the sheave pairs 92, 93 and 94, 95 to which ropes extend directly from the drum 58, rotate at a much faster speed than the sheaves 88 and 90 which are more remote from the drum 58. This is the case since, for example, for each unit length of raising or lowering distance, more rope must pass around the sheaves 92, 93 and 94 and 95 than passes around sheaves 88 and 90. e.g., for the lifting beam to be raised one foot, four feet of rope must pass around sheaves 92 and 93 and two feet of rope must pass around each of sheaves 88 and 90. When a lifting beam raising or lowering operation is in progress, and the lifting beam is subjected to swaying forces or is for some other reason not centered below the drum 58, use of double grooved single sheaves, such as sheaves 88 and 90 having their wrapped ropes extending directly to the drum 58 results in a high resistance to rotation of the sheaves 88 and 90. The effect of the high resistance to rotation of the double grooved single sheaves 88, 90 and the high speed of the sheaves 92, 93 and 94, 95 where the ropes go directly from the sheaves to the drum 58 is to rapidly grind through the ropes wrapped about the sheaves. The use of pairs of single grooved sheaves 92, 93 and 94, 95 at the ropes that connect directly to the drum, since it permits relatively free and faster rotating movement of these sheaves, minimizes the rope grinding problem. In the reeving system of the invention, independently rotatable, single grooved sheave pairs are utilized at locations where the wrapped rope extends directly to the drum and single double grooved sheaves are used at locations more remote from the drum where the wrapped ropes do not extend directly to the drum. This system maintains a high level of wrapping contact between the ropes and the sheaves 92, 93 and 94, 95 and minimizes rope jumping due to higher fleet angles caused by movement of the rope on the drum and grinding of the rope due to high speeds while at the same time obtaining the higher anti-sway benefits of a single sheave double grooved reeving arrangement.

It will be understood that the foregoing description of the present invention is for purposes of illustration only and that the invention is susceptible to a number of modifications or changes, none of which entail any departure from the spirit and scope of the present invention as defined in the hereto appended claims.

What is claimed is:

1. A reeving apparatus for a crane having an overhead frame, winding drum means mounted on the frame for raising and lowering a lifting beam and having a longitudinal axis, and a lifting beam positioned below the frame and subject to swaying forces and movement transverse to the vertical comprising:

first, second, third and fourth spaced-apart rotatable sheave means affixed to and swaying with the lifting beam for supporting and positioning the lifting beam, the first and second sheaves being spaced apart in directions horizontally transverse to the axis of the drum and the third and fourth sheave means being spaced apart from each other and from the first and second sheave means in directions parallel to the axis of the drum means;

alternate ones of the first, second, third and fourth sheave means comprising single sheaves having first and second grooves and the other ones of the first, second, third and fourth sheave means comprising a pair of sheaves each having single grooves;

a plurality of rope means each affixed to the drum means and overhead frame and wrapped around one of the first, second, third and fourth sheave means for supporting the lifting beam with the sheave means;

the plurality of rope means including first and second rope means extending to and wrapping around the same alternate one of the first, second, third and fourth sheave means in one of the first and second grooves for generating friction forces with said alternate one of the sheave means in response to swaying movement which dissipate the energy of the swaying forces on the lifting beam; and said first and second rope means each extending to and wrapping around a single groove of a pair of sheaves of a different other one of the first, second, third and fourth sheave means for supplying rope to the alternate ones of the first, second, third and fourth sheave means to allow their swaying movement.

2. The reeving apparatus according to claim 1 wherein:

the drum means has opposite ends; and the alternate ones of the first, second, third and fourth sheave means are positioned in opposite horizontally transverse directions of the axis of the drum means and the other ones of the first, second, third and fourth sheave means are positioned below the opposite ends of the drum means.

3. The reeving apparatus according to claim 2 wherein:

the plurality of rope means are wound onto or payed out from the drum means respectively during raising and lowering of the lifting beam;

the first and second rope means and the alternate ones of the sheave means rotate together during raising and lowering of the lifting beam and are restrained from such rotation during said generation of friction forces in response to swaying movement; and the first and second rope means extend from said other ones of the sheave means directly to the drum and are freely rotatable with the other ones of the sheave means during simultaneous raising or lowering of the lifting beam and swaying movement whereby the restrained rotation of the alternate ones of the sheave means during swaying movement has a minimum effect on raising and lowering of the lifting beam.

4. A reeving apparatus for a crane having an overhead frame, a lifting beam positioned below the frame and subject to swaying forces and movement transverse to the vertical, rotatable winding drum means mounted on the frame and including a longitudinal axis and opposite ends for raising and lowering the lifting beam, comprising:

a plurality of spaced apart rotatable sheave means affixed to and movable with the lifting beam including first and second sheave means respectively underlying opposite ends of the drum means and third and fourth sheave means positioned intermediate the ends of the drum means and spaced apart in opposite transverse horizontal directions from the axis of the drum means, the first and second sheave means each comprising a pair of single grooved sheaves independently rotatable of each other, and the third and fourth sheave means each comprising a single double grooved sheave;

a plurality of rope means for supporting the lifting beam and including first, second, third and fourth rope means each having opposite first and second end sections, the first end sections being affixed to and wrapped around the drum means and the second end sections being affixed to the overhead frame;

the first end sections of the first and second rope means being adjacent each other and extending from the drum means downward to the first sheave means and separately wrapping around one of the pair of single grooved sheaves of the first sheave means for maintaining wrapping contact between the first and second rope means and the first sheave means, second end sections of the first and second rope means extending from the overhead frame downward respectively to the third and fourth sheave means and wrapping around one of the grooves of the third and fourth sheave means for generating friction forces with the third and fourth sheave means which dissipates the energy of the swaying forces on the lifting beam, the first end sections of the third and fourth rope means being adjacent each other and extending from the drum means downward to the second sheave means and separately wrapping around one of the pair of single grooved sheaves of the second sheave means for maintaining wrapping contact between the third and fourth rope means and the second sheave means, the second end sections of the third and fourth rope means extending from the overhead frame downward respectively to the third and fourth sheave means and wrapping around one of the grooves of the third and fourth sheave means for generating friction forces with the third and fourth sheave means which dissipates the energy of the swaying forces on the lifting beam.

5. The reeving apparatus according to claim 4 wherein:

each of the plurality of rope means have a length and a travel movement in the direction of the length;

the first and second sheave means are more movable than the third and fourth sheave means in response to said swaying forces due to the friction forces generated by the plurality of rope means with the third and fourth sheave means; and the plurality of rope means are movable with the first and second sheave means in the direction of travel movement of each of the rope means toward the third and fourth sheave means to supply rope means permitting increased sway movement of the third and fourth sheave means.

6. The reeving apparatus according to claim 4 wherein:

each of the plurality of rope means have a length and a travel movement in the direction of the length; and the third and fourth sheave means are responsive to the friction forces to decrease movement of each of the rope means in the direction of their travel movement toward one of the first and second sheave means whereby the latter have decreased sway movement.

7. The reeving apparatus according to claim 4 wherein:

each of the plurality of rope means have a length and a travel movement in the direction of the length;

the third and fourth sheave means are less movable than the first and second sheave means and the travel movement of the plurality of rope means is restrained in response to said swaying forces due to the friction forces generated by the plurality of rope means with the third and fourth sheave means; and the first and second sheave means have decreased sway movement in response to the restrained travel movement of the plurality of rope means.

8. The reeving apparatus according to claim 4, 6 or 7 wherein the first and second sheave means are movable in response to swaying forces on the third and fourth sheave means to move the plurality of rope means toward and thereby supply rope means to the third and fourth sheave means to permit increased sway movement of the third and fourth sheave means.

9. The reeving apparatus according to claim 4 wherein:

the second end sections of the first and second rope means respectively have a first fleet angle with the third and fourth sheave means and the second end sections of the third and fourth rope means respectively have a second fleet angle with the third and fourth sheave means;

the first end sections of the first and second rope means respectively have a third fleet angle with the first sheave means and the first end sections of the third and fourth rope means respectively have a fourth fleet angle with the second sheave means, the third and fourth fleet angles being greater than the first and second fleet angles;

the first and second rope means and the third and fourth sheave means rotate together during raising and lowering of the lifting beam and are restrained from such rotation during said generation of friction forces in response to swaying movement; and the first and second rope means extending from the first sheave means and the third and fourth rope means extending from the second sheave means are freely rotatable during simultaneous raising or lowering of the lifting beam and swaying movement whereby the free rotation of the first and second sheave means minimizes the tendency of the first and second rope means and the third and fourth rope means to respectively jump from the first and second sheave means at the greater second fleet angle while at the same time the first and second rope means together with the third and fourth sheave means dissipate swaying force energy.

10. A reeving apparatus for a crane having an overhead frame, a lifting beam positioned below the frame and subject to swaying forces and movement transverse to the vertical, rotatable winding drum means mounted on the frame and including a longitudinal axis and opposite ends for raising and lowering the lifting beam, comprising:

a plurality of spaced apart rotatable sheave means affixed to the lifting beam and movable in response to the swaying forces, the plurality of sheave means including first and second sheave means respectively underlying opposite ends of the drum means and third and fourth sheave means positioned intermediate the ends of the drum means and spaced apart in opposite transverse horizontal directions relative to the axis of the drum means, the first and second sheave means each comprising a pair of single grooved sheaves independently rotatable of each other and the third and fourth sheave means each comprising a single double grooved sheave;

a plurality of rope means for supporting the lifting beam and including first, second, third and fourth rope means each having opposite first and second end sections, the first end sections being affixed to and wrapped around the drum means and the second end sections being affixed to the overhead frame;

the second end sections of the first and second rope means each wrapping around one of the grooves of a different one of the third and fourth sheave means and respectively extending upward to the overhead frame from the third and fourth sheave means at a first fleet angle for generating friction forces with the third and fourth sheave means which dissipates the energy of the swaying forces on the lifting beam both in the directions of and transverse to the longitudinal axis of the drum means, the first end sections of the first and second rope means separately wrapping around one of the pair of single grooved sheaves of the first sheave means and extending upward adjacent each other from the first first sheave means to the drum means at a second fleet angle greater than the first fleet angle for maintaining wrapping contact between the first and second rope means and the first sheave means as the first and second rope means rotate with the first sheave means at said second fleet angle during raising and lowering of the lifting beam; and the second end sections of the third and fourth rope means each wrapping around one of the grooves of a different one of the third and fourth sheave means and respectively extending upward to the overhead frame from the third and fourth sheaves means at said first fleet angle for generating friction forces with the third and fourth sheave means which dissipates the energy of the swaying forces on the lifting beam both in the directions of and transverse to the longitudinal axis of the drum means, the first end sections of the first and second rope means separately wrapping around one of the pair of single grooved sheaves of the second sheave means and extending upward adjacent each other from the second sheave means to the drum means at said second fleet angle greater than the first fleet angle for maintaining wrapping contact between the first and second rope means and the second sheave means as the first and second rope means rotate with the second sheave means at said second fleet angle during raising and lowering of the lifting beam.

11. The reeving apparatus according to claim 10 wherein the third and fourth sheave means have a first level of continuous engagement with the rope means wrapped around each of the third and fourth sheave means and the first and second sheave means have a second level of continuous engagement with the rope means wrapped around each of the first and second sheave means, the second level of engagement being greater than the first level of engagement whereby jumping of the first and second rope means from the grooves of the first and second sheave means due to the greater second fleet angles is minimized.

12. The reeving apparatus according to claim 10 or 11 wherein:

the first and second rope means and the third and fourth sheave means rotate together during raising and lowering of the lifting beam and are restrained from such rotation during said generation of friction forces in response to swaying movement; and the first and second rope means extending from the first sheave means and the third and fourth rope means extending from the second sheave means are freely rotatable during simultaneous raising or lowering of the lifting beam and swaying movement whereby the free rotation of the first and second sheave means minimizes the tendency of the first and second rope means and the third and fourth rope means to respectively jump from the first and second sheave means at the greater second fleet angle while at the same time the first and second rope means together with the third and fourth sheave means dissipate swaying force energy.

13. A reeving apparatus for a crane having an overhead frame, a lifting beam positioned below the frame and subject to swaying forces and movement transverse to the vertical, rotatable winding drum means mounted on the frame and including a longitudinal axis and opposite ends for raising and lowering the lifting beam, comprising:

a plurality of spaced apart rotatable sheave means affixed to the lifting beam including first and second sheave means respectively underlying opposite ends of the drum means and third and fourth sheave means positioned intermediate the end of the drum means and spaced apart in opposite transverse horizontal directions relative to the axis of the drum means, the first and second sheave means each comprising a pair of single grooved sheaves independently rotatable of each other, and the third and fourth sheave means each comprising a single double grooved sheave;

a plurality of rope means for supporting the lifting beam and including first, second, third and fourth rope means each having opposite first and second end sections, the first end sections being affixed to and wrapping around the drum means and the second end sections being affixed to the overhead frame;

the second end section of the first and second rope respectively extending from the overhead frame downward and wrapping around and rotating at a first speed with the third and fourth sheave means for generating friction forces with the third and fourth sheave means which dissipates the energy of the swaying forces on the lifting beam, the first end section of each of the first and second rope means extending from the drum means downward to and separately wrapping around and rotating independently of each other with one of the pair of single groove sheaves of the first sheave means at a second speed faster than the first speed during said generation of friction forces by the third and fourth sheave means for minimizing disengagement of the first and second rope means with the first sheave means; and the second end sections of the third and fourth rope means respectively extending from the overhead frame downward to and wrapping wrapping around and rotating at said first speed with the third and fourth sheave means for generating friction forces with the third and fourth sheave means which dissipates the energy of the swaying forces on the lifting beam, the first end section of each of the third and fourth rope means extending from the drum means downward to and separately wrapping around and rotating independently of each other with one of the pair of single grooved sheaves of the second sheave means at said second speed faster than the first speed during said generation of friction forces by the third and fourth sheave means for minimizing disengagement of the third and fourth rope means from the second sheave means whereby swaying of the lifting beam is minimized by the interaction of the third and fourth sheaves and the plurality of ropes while at the same time jumping of the plurality of ropes at their downward extensions from the drum means to the first and second sheaves is minimized by the faster speed rotation of the plurality of ropes around the first and second sheave means.

* * * * *